US006085050A

United States Patent [19]

Rowe et al.

[11] Patent Number: 6,085,050

[45] Date of Patent: Jul. 4, 2000

[54] REPRODUCTION MACHINE HAVING AN AUTOMATIC VARIABLE MACHINE SPEED CONTROL METHOD AND APPARATUS

[75] Inventors: Joseph H. Rowe, Webster; Roger L. Miller, Rochester, both of N.Y.

[73] Assignee: Xerox Corporation, Stamford, Conn.

[21] Appl. No.: 09/358,234

[22] Filed: Jul. 21, 1999

Related U.S. Application Data

[60] Provisional application No. 60/112,819, Dec. 17, 1998.

[51] Int. Cl.[7] ..... G03G 15/00

[52] U.S. Cl. ..... 399/75; 399/67

[58] Field of Search ..... 399/75, 76, 26, 399/27, 30, 58, 60, 61, 62, 297, 301, 67, 68

[56] References Cited

U.S. PATENT DOCUMENTS

| | | | |
|---|---|---|---|
| 5,204,698 | 4/1993 | LeSueur et al. | 346/160 |
| 5,349,377 | 9/1994 | Gilliland et al. | 346/153.1 |
| 5,455,656 | 10/1995 | Covert et al. | 399/26 |
| 5,587,783 | 12/1996 | Nakamura et al. | 399/301 |

*Primary Examiner*—Fred L. Braun
*Assistant Examiner*—Hoan Tran
*Attorney, Agent, or Firm*—Tallam I. Ngun

[57] ABSTRACT

An electrostatographic toner image reproduction machine is provided for producing toner reproductions of original images. The reproduction machine includes a frame; a movable image bearing member mounted to and having a path of movement within the frame; and electrostatographic process devices mounted for forming a toner image, transferring and fusing the toner image onto a copy sheet; and at least one status parameter defining a quality condition of the formed, transferred and fused toner images. The reproduction machine also includes measuring devices for measuring the at least one status parameter; at least first and second different machine speeds at which to operate the machine; and a machine controller connected to the measuring devices for automatically changing the machine speed in response to each of the at least one status parameter so as to ensure continued production of high quality toner images. The machine controller is programmed to read a Start-Of-Copy (SOCS) status of the at least one status parameter; a rate of change (ROC) of the at least one status parameter; an acceptable Normal End-Of-Copy value range (NEOCVR) of the at least one status parameter; and a Default machine speed (DMS) of the machine. The machine controller is also programmed to measure the at least one status parameter and calculate a Predicted End-Of-Copy Value (PEOCV) of the at least one status parameter given the DMS of the machine, to compare the PEOCV with the NEOCVR, and to automatically change the Default machine speed (DMS) of the machine to an Adjusted Machine speed (AMS) in order for the PEOCV of the at least one status parameter, given the AMS, to be within the acceptable NEOCVR, thereby ensuring continued production of high quality toner images.

8 Claims, 2 Drawing Sheets

REPRODUCTION MACHINE HAVING AN AUTOMATIC VARIABLE MACHINE SPEED CONTROL METHOD AND APPARATUS

This application is based on a provisional application no. 60/112,819, filed Dec. 17, 1998.

BACKGROUND

This invention relates to electrostatographic reproduction machines, and more particularly to an electrostatographic reproduction machine including an intra-job automatic variable machine speed control method and apparatus.

Generally, the process of electrostatographic reproduction includes charging a photoconductive member to a substantially uniform potential so as to sensitize the surface thereof. A charged portion of the photoconductive surface is exposed, for example digitally, at an exposure station to a light image of an original document to be reproduced. Typically, an original document to be reproduced is placed in registration, either manually or by means of an automatic document handler (ADH), on a platen for such exposure. In general, the exposure station includes a means, such as a raster input scanner (RIS) device in a digital machine, for electronically and digitally capturing image information by scanning the document on the platen. When scanning a multicolor original image, the RIS device produces digitized video signals corresponding to color separated images of the original image. Digital machines also each include a raster output scanner (ROS) device for writing or exposing onto the charged photoreceptor, the RIS electronically or digitally captured image.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two-component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" or finished copy of the original image. The finished copy of each original document is then fed to an output tray for subsequent removal and use by an operator.

Development or application of toner particles as above typically depletes toner particles at some rate from developer material in a development unit of the machine. Different jobs of several documents being reproduced, will cause toner depletion at different rates depending on the copy sheet area coverage level by toner particles. In a machine using two component developer material, such depletion undesirably changes the concentration of such particles in the developer material. In order to maintain the concentration of toner particles within the developer material (so as to insure the quality of subsequent images), the depleted toner particles must be replenished at some fixed or variable rate with fresh toner particles. Such fresh toner particles must then be admixed with the carrier particles in order to properly charge them triboeletrically. Unfortunately, there are jobs or sequences in jobs wherein the toner usage or depletion rate far exceeds the fresh toner replenishment and admix rate, ordinarily resulting in poor quality reproductions or machine stoppage and recovery time.

A similar problem is also associated with fusing temperature maintenance wherein a "droop" or "sag" in fusing temperature due to any of several factors, ordinarily too will result in poor quality reproductions. Conventional attempts to avoid such poor quality reproductions have typically involved temporarily suspending the imaging process in order to give the replenishment system time to recover. This is usually the approach because reproduction machines typically have a fixed speed or machine speed.

Examples of references forming a background for the measuring or sensing aspect of the present invention include the following patents. U.S. Pat. No. 5,204,698 discloses a laser printer in which a latent image is generated on a circulating imaging member in accordance with digital image signals and subsequently developed with toner, the number of pixels to be toned is used as an indication of the rate at which toner is being depleted from the developer mixture. The device for dispensing fresh toner to the developer mixture is operated in dependence on the number of pixels to be toned so that there is a pre-established relationship between the pixel count and the length of time for which the dispensing device is in operation. If the efficiency of the dispensing device falls, the pre-established relationship is adjusted so that the toner density in the developed images remains constant. If a predetermined level of adjustment is reached, it is taken as an indication that the supply of toner in the printer is low, and should be replenished.

U.S. Pat. No. 5,349,377 issued Sep. 20, 1994, discloses a process known as pixel counting. The toner usage per copy depends upon primarily the percent of the copy that is covered by toner and the density of the covered area. In electrophotographic printers where the document is scanned, commonly known as scanning printers, the areas or pixels, which represent portions of the text, may be used as an indicator of the amount of toner to be used. This pixel counting system is used in conjunction with an algorithm to determine the amount of toner used per page being printed and, subtracting the used toner from the amount of toner in a full container, determines the current toner level. From this current toner level, a toner low warning is presented to the operator.

SUMMARY OF THE INVENTION

In accordance with the present invention, there is provided an lo electrostatographic toner image reproduction machine is provided for producing toner reproductions of original images. The reproduction machine includes a frame; a movable image bearing member mounted to and having a path of movement within the frame; and electrostatographic process devices mounted along the path of movement for forming a toner image on the image bearing member, transferring and fusing the toner image onto a copy sheet, at least one device of the electrostatographic process devices having at least one status parameter defining a quality condition of the formed, transferred and fused toner images produced by the machine. The reproduction machine also includes measuring devices for measuring the at least one status parameter of the machine; at least first and second different machine speeds at which to operate the machine; and a machine controller connected to the measuring devices for automatically changing the machine speed in response to each of the at least one status parameter so as to insure continued production of high quality toner images. The machine controller is programmed to read a Start-Of-Copy (SOCS) status of the at least one status parameter; a rate of change (ROC) of the at least one status parameter, an acceptable Normal End-Of-Copy value range (NEOCVR) of the at least one status parameter; and a Default machine speed (DMS) of the machine. The machine controller is also programmed to measure the at least one status parameter of the machine and calculate a Predicted End-Of-Copy Value (PEOCV) of the at least one status parameter given the DMS of the machine to compare the PEOCV with the NEOCVR, and to automatically change the Default machine speed (DMS) of the machine to an Adjusted Machine speed (AMS) in order for the PEOCV of the at least one status parameter, given the AMS, to be within the acceptable NEOCVR, thereby insuring continued production of high quality toner images.

In accordance with another aspect of the present invention, there is provided in an electrostatographic reproduction machine including an intra-job automatic variable machine speed controlling method. The intra-job automatic variable machine speed controlling method includes the steps of (i) reading a Start-Of-Copy (SOCS) status of the at least one status parameter; a rate of change (ROC) of the at least one status parameter, an acceptable Normal End-Of-Copy value range (NEOCVR) of the at least one status parameter; and a Default machine speed (DMS) of the machine; (ii) measuring the at least one status parameter of the machine and calculating a Predicted End-Of-Copy Value (PEOCV) of the at least one status parameter given the DTR of the machine; (iii) comparing the PEOCV with the NEOCVR; and (iv) automatically changing the Default machine speed (DMS) of the machine to an Adjusted Machine speed (AMS) in order for the PEOCV of the at least one status parameter, given the AMS, to be within the acceptable NEOCVR, thereby insuring continued production of high quality toner images.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
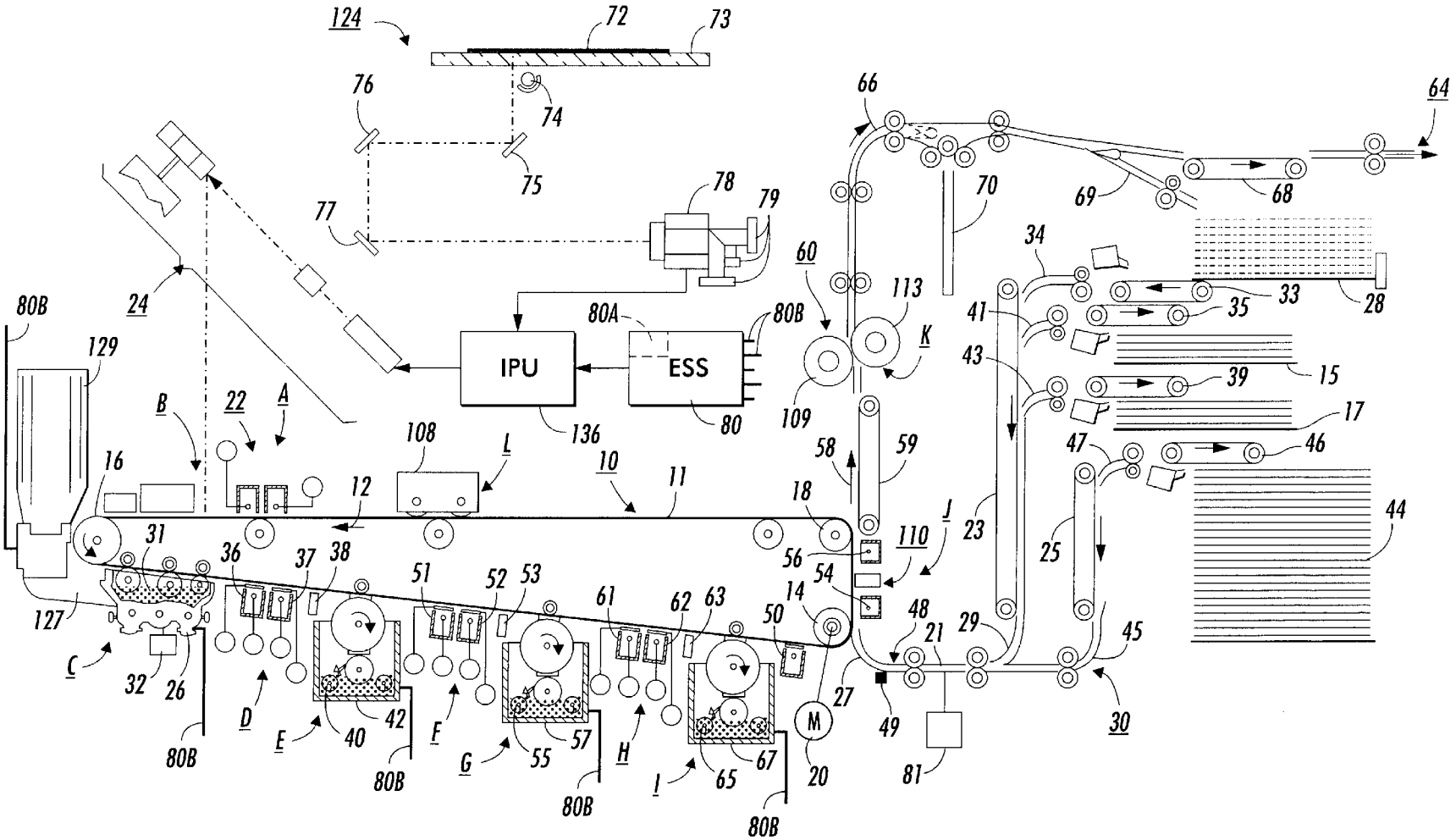
FIG. 1 is a schematic illustration of a first embodiment of an exemplary toner image reproduction machine incorporating the control method of the present invention.

Referring to FIG. 1, there is depicted a first embodiment of an exemplary image-on-image printing or reproduction machine 8. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS) 80 including the apparatus and method for automatic variable machine speed control method and apparatus of the present invention (to be described in detail below).

The ESS is preferably a self-contained, dedicated minicomputer having a central processor unit (CPU), electronic storage, and a display or user interface (UI). The ESS is the control system which with the help of sensors and connections 80B as well as a pixel counter 80A, reads, captures, prepares and manages the image data flow between IPU 136 and image input terminal 122, 124. In addition, the ESS 80 is the main multi-tasking processor for operating and controlling all of the other machine subsystems including its variable drive system and printing operations. These printing operations include imaging, development, sheet delivery, image transfer and fusing, as well as various functions associated with subsequent finishing processes. Some or all of these subsystems may have micro-controllers that communicate with the ESS 80.

The printing machine 8 employs a photoreceptor 10 in the form of a belt having a photoconductive surface layer 11 on an electroconductive substrate 13. Preferably the surface 11 is made from an organic photoconductive material, although numerous photoconductive surfaces and conductive substrates may be employed. The belt 10 is driven at variable speeds in accordance with the present invention by means of motor 20 having an encoder attached thereto (not shown) to generate a machine timing clock. As is well known, at a given machine speed, the belt 10 is driven so as to be synchronized with other speed, timing and movement related functions and operations of the machine, including for example document and copy sheet movements. Overall, such speed of moving parts and timing of functions determines whether the effective throughput of the machine is 44 PPM (prints per minute) or 40 PPM. Photoreceptor 10 is moved as such along a path defined by rollers 14, 18, and 16 in a counter-clockwise direction as shown by arrow 12.

Initially, the photoreceptor 10 passes through charging station A where a corona generating device, indicated generally by the reference numeral 22, charges photoreceptor 10 to a relatively high, substantially uniform potential. Next, the charged portion of photoreceptor 10 is advanced through an imaging station B. At imaging station B, the uniformly charged belt 10 is exposed to the scanning device 24 which causes the photoreceptor to be discharged in accordance with the output from the scanning device. The scanning device is a laser Raster Output Scanner (ROS). The ROS creates the image in a series of parallel scan lines having a certain resolution, generally referred to as lines per inch. Scanning device 24 may include a laser with rotating polygon mirror blocks and a suitable modulator, or in lieu thereof, a light emitting diode array (LED) write bar positioned adjacent the photoreceptor 10.

At a first development station C, a magnetic brush development unit, indicated generally by the reference numeral 26 advances developer material 31 containing carrier particles and charged toner particles at a desired and controlled concentration into contact with the latent image and latent target marks. Development unit 26 has a plurality of magnetic brush roller members. These magnetic brush rollers transport developer material containing negatively charged black toner particles for example, to the latent image for development thereof. Power supply 32 electrically biases development unit 26. Development or application of the charged toner particles as above typically depletes the level and hence concentration of toner particles, at some rate, from developer material in the development unit 26. This is also true of the other development units of the machine 8.

Accordingly, different jobs of several documents being reproduced, will cause toner depletion at different rates depending on the copy sheet area coverage level by toner particles. In a machine using two component developer material as here, such depletion undesirably changes the concentration of such particles in the developer material. In order to maintain the concentration of toner particles within the developer material (in an attempt to insure the quality of subsequent images), the depleted toner particles must be replenished at some fixed or variable rate by a device 127 with fresh toner particles from a source 129. Such fresh toner particles must then be admixed with the carrier particles in order to properly charge them triboeletrically.

Figure 2:
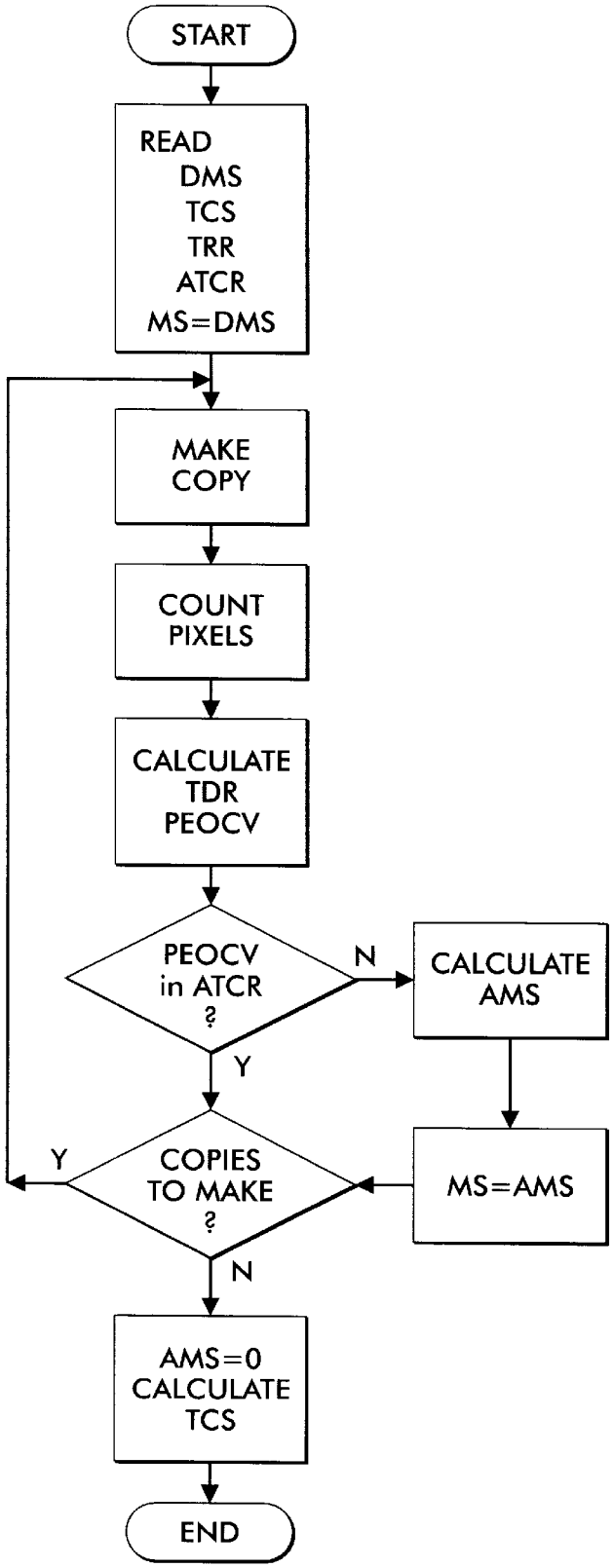
FIG. 2 a flow chart illustrating the control method in accordance with the present invention.

Referring now to FIGS. 1 and 2, where a desired and non-dusting rate of toner replenishment (TRR) of such toner particles is still not enough to insure continued quality development of images, the control method of the present invention is provided for reading and measuring a default machine speed (DMS), and calculating toner depletion by means such as pixel counting as disclosed for example in U.S. Pat. No. 5,349,377, relevant portions of which are herein incorporated by reference. The control method of the present invention then provides for calculating a toner depletion rate (TDR) and comparing such toner depletion and the replenishment rate TRR. The method than calls for changing the machine speed (MS) from the DMS value to a calculated actual machine speed (AMS), that is responsive to or is a function of toner depletion, and which is preferably slower than the DMS in order to allow toner replenishment to catch up with toner depletion, without speeding up toner replenishment and admixing, and without risking customer dissatisfaction by machine process suspension and delay.

Next at recharging station D, a pair of corona recharge devices 36 and 37 are employed for adjusting the voltage level of both the toned and untoned areas on photoreceptor 10 to a substantially uniform level. A power supply is coupled to each of the electrodes of corona recharge devices 36 and 37. Recharging devices 36 and 37 substantially eliminate any voltage difference between toned areas and bare untoned areas, as well as to reduce the level of residual charge remaining on the previously toned areas, so that subsequent development of different color toner images is effected across a uniform development field.

Imaging devices 38, 53, and 63 are used to superimpose subsequent images by selectively discharging the recharged photoreceptor. These imaging devices may include, for example, a LED image array bar, or another ROS. On skilled in the art will appreciate that the operation of imaging devices 38, 53, and 63 are also controlled by ESS 80. Moreover, one skilled in the art will recognize that those areas developed with black toner will not be subjected to sufficient light from the imaging devices to discharge the photoreceptor region lying below the black toner particles. However, this is of no concern as there is little likelihood of a need to deposit other colors over the black regions.

Imaging device 38 records a second electrostatic latent image on photoreceptor 10. A negatively charged developer material 40, for example, one including yellow toner, develops the second latent image. The toner is contained in a development unit 42 disposed at a second developer station E and is transported to the second latent image recorded on the photoreceptor by a donor roll. A power supply (not shown) electrically biases the development unit to develop this latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

At a second recharging station F, a pair of corona recharge devices 51 and 52 are employed for adjusting the voltage level of both the toned and untoned areas on photoreceptor 10 to a substantially uniform level. A power supply is coupled to each of the electrodes of corona recharge devices 51 and 52. The recharging devices 51 and 52 substantially eliminate any voltage difference between toned areas and bare untoned areas, as well as to reduce the level of residual charge remaining on the previously toned areas so that subsequent development of different color toner images is effected across a uniform development field. A third latent image is then recorded on photoreceptor 10 by imaging device 53. This image is developed using a third color toner 55 contained in a development unit 57 disposed at a third developer station G. An example of a suitable third color toner is magenta. Suitable electrical biasing of the development unit 57 is provided by a power supply, not shown.

At a third recharging station H, a pair of corona recharge devices 61 and 62 adjust the voltage level of both the toned and untoned areas on photoreceptor 10 to a substantially uniform level. A power supply is coupled to each of the electrodes of corona recharge devices 61 and 62. The recharging devices 61 and 62 substantially eliminate any voltage difference between toned areas and bare untoned areas as well as to reduce the level of residual charge remaining on the previously toned areas, so that subsequent development of different color toner images is effected across a uniform development field A fourth latent image is created using imaging device 63. The fourth latent image is formed on both bare areas and previously toned areas of photoreceptor 10 that are to be developed with the fourth color image. This image is developed, for example, using a cyan color toner 65 contained in development unit 67 at a fourth developer station I. Suitable electrical biasing of the development unit 67 is provided by a power supply, not shown.

Development units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. Appropriately each includes a toner replenishment device such as 127, and a source of fresh toner particles such as 129.

In order to condition the toner for effective transfer to a substrate, a negative pre-transfer corotron member 50 negatively charges all toner particles to the required negative polarity to ensure proper subsequent transfer.

During the exposure and development of the color image on the photoconductor, a sheet of support material is advanced to transfer station J by a sheet feeding apparatus 30. During simplex operation (single sided copy), a blank sheet may be fed from tray 15 or tray 17, or a high capacity tray 44 thereunder, to a registration transport 21, in communication with controller 81, where the sheet is registered in the process and lateral directions, and for skew position. One skilled in the art will realize that trays 15, 17, and 44 each hold a different sheet type. The speed of the sheet is adjusted at registration transport 21 so that the sheet arrives at transfer station J in synchronization with the image on the surface of photoconductive belt 10. Registration transport 21 receives a sheet from either a vertical transport 23 or a high capacity tray transport 25 and moves the received sheet to a pretransfer baffle 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets from tray 44 to transport 25 by a chute 47.

The pretransfer baffle 27 guides the sheet from the registration transport 21 to transfer station J. Charge limiter 49 located on pretransfer baffle 27 restricts the amount of electrostatic charge a sheet can place on the baffle 27 thereby reducing image quality problems and shock hazards. The charge can be placed on the baffle from either the movement of the sheet through the baffle or by the corona generating devices located at transfer station J. When the charge exceeds a threshold limit, charge limiter 49 discharges the excess to ground.

Transfer station J includes a transfer corona device 54 which provides positive ions to the backside of the copy sheet. This attracts the negatively charged toner powder images from photoreceptor belt 10 to the sheet. A detack corona device 56 is provided for facilitating stripping of the sheet from belt 10.

A sheet-to-image registration detector 110 is located in the gap between the transfer and corona devices 54 and 56 to sense variations in actual sheet to image registration and provides signals indicative thereof to ESS 80 and controller 81 while the sheet is still tacked to photoreceptor belt 10. After transfer, the sheet continues to move, in the direction of arrow 58, onto a conveyor 59 that advances the sheet to fusing station K.

Fusing station K includes a fuser assembly, indicated generally by the reference numeral 60, which permanently fixes the transferred color image to the copy sheet. Preferably, fuser assembly 60 comprises a heated fuser roller 109 and a backup or pressure roller 113. As is well known, the heated fuser roller must be maintained at a desirable and suitable temperature for produced high quality fused toner images. There are however circumstances including copy sheet temperature and amount of toner to be fused that can cause a drop or "droop" in the temperature of the fuser roller. In accordance with the present invention, the machine speed MS can also be varied automatically under such circumstances from DMS to AMS in order to continue to produce quality images.

As shown, the copy sheet passes between fuser roller 109 and backup roller 113 with the toner powder image contacting fuser roller 109. In this manner, the multi-color toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station J, in the same manner as the image was deposited on the first side thereof. The completed duplex copy exits to the finishing module (not shown) via output 64.

After the sheet of support material is separated from photoreceptor 10, the residual toner carried on the photoreceptor surface is removed therefrom. The toner is removed at cleaning station L using a cleaning brush structure contained in a unit 108.

The ESS 80 in accordance with the present invention, thus includes software for enabling the machine 8 to change the machine process speed from say 44 PPM to 40 PPM. Such a change involves slowing down the rate at which certain operations are carried out, as well as results in an increase in the inter-document gap within a job. Thus if at the conclusion of the first copy of a job being run, if the pixel count exceeds a predetermined value, thus indicating a potential for toner particle starvation or fuser temperature droop at the fuser, the overall machine speed or throughput rate will be changed to a lower value in order to continue to produce high quality images. The machine 20, thereafter continues to run at this new throughput rate or speed for the duration of the job being run. The rate or speed change does not have to be discrete, but could be determined by an algorithm. Thus as the area toner coverage increases or the fuser temperature "droops" or decreases, the machine speed and copy throughput rate in accordance with the present invention will decrease.

Referring in particular to FIG. 2, the method of the present invention is illustrated with respect to "toner concentration" as the status parameter that changes conditions during operation of the machine. As shown, the method calls for reading a default machine speed (DMS), a toner concentration status (TCS) at the start which is equivalent to a start of copy status (SOCS) as claimed, a toner replenishment rate (TRR), and an acceptable range (ATCR) for toner concentration values. ATCR is equivalent to the normal End-of-copy value range as claimed. The method then sets the operating machine speed MS at the start of any job to DMS.

Copies are then made sequentially as described above, with the pixel counter counting pixels formed for development by each development unit for purposes of determining area toner coverage. From this or other means the method calls for the calculation of an actual toner depletion rate (TDR) equivalent to the rate of change (ROC) claimed, and a predicted end-of-copy value (PEOCV) for the toner concentration TCS given the TDR, TRR and DMS. The PEOCV is compared to the ATCR to see if it will be within the range. As shown, if the answer is yes, meaning it will be within the range, then the copying or making of copies continues if there are more copies to make. However, if the answer is no, the method calculates an actual machine speed (AMS) at which the PEOCV will be within the range, and then changes the machine speed MS from DMS to AMS and proceeds to make copies at the AMS speed when there are copies still to be made. AMS is of course less than DMS in order to allow toner replenishment (TRR) to catch up, without speeding up toner replenishment and admixing, and without risking customer dissatisfaction by machine process suspension and delay. When there are no longer additional copies to made, the method calls for determining and storing a toner concentration value (TCS) and resetting the machine speed MS to DMS before ending the job.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

What is claimed is:

1. An electrostatographic reproduction machine for producing toner reproductions of original images on copy substrates using developer material containing replenishable toner particles, the reproduction machine comprising:

(a) a frame;

(b) a movable image bearing member mounted to and having a path of movement within said frame;

(c) electrostatographic process devices mounted along said path of movement for forming a toner image on said image bearing member, transferring and fusing said toner image onto a copy sheet, at least one device of said electrostatographic process devices having at least one status parameter defining a quality condition of said formed, transferred and fused toner images produced by the machine;

(d) measuring means for measuring said at least one status parameter;

(e) at least first and second different machine speeds at which to operate the machine; and (f) a machine controller connected to said measuring means for controlling each said at least one status parameter so as to ensure continued production of high quality toner images, said machine controller including:

(i) means for reading a Start-Of-Copy (SOCS) status of said at least one status parameter; an acceptable Normal End-Of-Copy value range (NEOCVR) of said at least one status parameter; and a Default machine speed (DMS) of the machine;

(ii) means for calculating a rate of change (ROC) of said at least one status parameter, and a Predicted End-Of-Copy Value (PEOCV) of said at least one status parameter given the DMS of the machine;

(iii) means for comparing said PEOCV with said NEOCVR; and (iv) means for automatically changing said Default machine speed (DMS) of the machine to an Adjusted Machine speed (AMS) in order for said PEOCV of said at least one status parameter, given said AMS, to be within said acceptable NEOCVR, thereby ensuring continued production of high quality toner images.

2. The electrostatographic reproduction machine of claim 1, wherein said means for comparing said PEOCV with said NEOCVR comprises means for determining if said PEOCVC falls outside said acceptable normal range of values (NEOCVR) of said at least one status parameter.

3. The electrostatographic reproduction machine of claim 1, wherein said at least one status parameter defining a condition of the machine comprises a toner concentration for the developer material in the machine.

4. The electrostatographic reproduction machine of claim 1, wherein said at least one status parameter defining a condition of the machine comprises a fusing temperature of the fusing apparatus of the machine.

5. The electrostatographic reproduction machine of claim 3, wherein said rate of change of said at least one status parameter comprises a rate of fresh toner replenishment (RTR) into the developer material in the machine.

6. In an electrostatographic reproduction machine having measuring means for measuring at least one status parameter, and at least first and second different machine speeds at which to operate the machine, an intra-job automatic variable machine speed controlling method comprising the steps of:

(a) reading a Start-Of-Copy (SOCS) status of the at least one status parameter; an acceptable Normal End-Of-Copy value range (NEOCVR) of the at least one status parameter; and a Default machine speed (DMS) of the machine;

(b) at the end of reproducing a number of sheets, measuring the at least one status parameter of the machine and calculating a rate of change (ROC) of said at least one status parameter, and a Predicted End-Of-Copy Value (PEOCV) of the at least one status parameter given the DMS of the machine;

(c) comparing the PEOCV with the NEOCVR; and (d) automatically changing the Default machine speed (DMS) of the machine to an Adjusted Machine speed (AMS) in order for the PEOCV of the at least one status parameter, given the AMS, to be within the acceptable NEOCVR, thereby ensuring continued production of high quality toner images.

7. The method of claim 6, wherein said measuring and calculating step comprises calculating a Predicted End-Of-Copy Value (PEOCV) of the at least one status parameter given the DMS of the machine at the end of reproducing a number of sheets within a job containing many sheets.

8. The method of claim 6, including a step of resetting the machine speed from an actual machine speed (AMS) which comprises calculating a Predicted End-Of-Copy Value (PEOCV) of the at least one status parameter given the DMS of the machine at the end of reproducing a number of sheets within a job containing many sheets.

* * * * *